US005194221A

United States Patent [19]

Culling

[11] Patent Number: 5,194,221

[45] Date of Patent: Mar. 16, 1993

[54] HIGH-CARBON LOW-NICKEL HEAT-RESISTANT ALLOYS

[75] Inventor: John H. Culling, St. Louis, Mo.

[73] Assignee: Carondelet Foundry Company, St. Louis, Mo.

[21] Appl. No.: 817,751

[22] Filed: Jan. 7, 1992

[51] Int. Cl.[5] ..... C22C 38/44

[52] U.S. Cl. ..... 420/53; 420/47; 420/40; 420/586.1

[58] Field of Search ..... 420/40, 47, 53, 586, 420/584, 585, 586.1

[56] References Cited

U.S. PATENT DOCUMENTS

| | | | |
|---|---|---|---|
| Re. 27,226 | 11/1971 | Moskowitz et al. | 420/44 |
| 2,416,515 | 2/1947 | Evans, Jr. et al. | 420/40 |
| 2,537,477 | 1/1951 | Mohling et al. | 420/47 |
| 2,857,266 | 10/1958 | Anger | 420/584 |
| 3,146,136 | 8/1964 | Bird et al. | 420/584 |
| 3,758,294 | 9/1973 | Bellot et al. | 420/55 |
| 4,077,801 | 3/1978 | Heyer | 420/54 |
| 4,430,297 | 2/1984 | Crook | 420/442 |
| 4,861,547 | 8/1989 | Culling | 420/53 |
| 4,927,602 | 5/1990 | Culling | 420/586 |
| 5,077,006 | 12/1991 | Culling | 420/584.1 |

FOREIGN PATENT DOCUMENTS 53-40622 4/1978 Japan .

*Primary Examiner*—Deborah Yee

*Attorney, Agent, or Firm*—Senniger, Powers, Leavitt & Roedel

[57] ABSTRACT

Air-meltable, castable, machinable, weldable heat-resistant alloys that are very resistant to hot gas corrosion and that exhibit high creep rupture strengths. The alloys are, by weight, about 7.5 to aboout 18% nickel, about 23.5 to about 35% chromium, about 0.85 to about 1.4% carbon, about 0.2 to about 1.8% molybdenum, about 0.2 to about 1.6% tungsten, about 0.1 to about 1.6% columbium (niobium), about 0.2 to about 4% manganese, about 0.2 to about 2.5% silicon, up to about 1.5% cobalt, up to about 0.6% titanium, up to about 0.4% zirconium, up to about 0.4% rare earth elements, up to about 0.1% boron, up to about 0.7% nitrogen, and the balance essentially iron plus the usual minor impurities.

15 Claims, 1 Drawing Sheet

HIGH-CARBON LOW-NICKEL HEAT-RESISTANT ALLOYS

This invention relates to high-carbon, low-critical-element casting alloys suitable for use in the manufacture of structural parts which require high hot strength and resistance to hot gas corrosion at temperatures up to about 2000° F. to 2100° F. The alloys of the invention are machinable, weldable and air meltable.

BACKGROUND OF THE INVENTION

Today's industrial furnace castings are almost invariably cast from alloys selected from the standard alloys specified by the Alloy Castings Institute division of the Steel Founders Society of America (SFSA-ACI) or from various modifications of these alloys. These standard alloys generally contain 19% to 32% chromium, 9% to 68% nickel, 0.20% to 0.75% carbon, with the balance being substantially iron (all elemental percentages herein are in terms of weight percent unless otherwise specified). These alloys also often contain small amounts of manganese and silicon, as employed in steelmaking practice, and even smaller amounts of impurities. The exact proportions of these elements vary from grade to grade. The grade designated as type HP has the best hot strength of all the standard ACI grades and nominally contains about 35% nickel, 25% chromium and 0.45% carbon.

Over a period of several decades, efforts have been made to improve the properties of these alloys by increasing the chromium, nickel, manganese and/or silicon content as well as adding one or more other selected elements.

In the case of precision castings for use in high temperature applications where the casting must also be resistant to abrasion, corrosion, impact, and thermal shock and must maintain dimensional stability, very difficult and expensive production methods and expensive alloys have been employed to address these requirements. Typical of such applications are castings for jet engine turbine rotor blades. In the case of alloys for rotor blade castings, which are usually nickel-base or cobalt-base alloys, the alloys may contain scarce elements in various proportions such as up to several percent by weight of two or more elements from the tantalum or cobalt pair, the quite scarce vanadium, columbium (niobium) and zirconium group, the fairly scarce tungsten and titanium pair, and/or more plentiful elements from the molybdenum and boron pair. Virtually every other element that is metallurgically compatible has also been tried in various combinations and proportions for this application.

Because of the great differences in tonnage of furnace part castings versus the tonnage in rotor blade castings the truly scarce elements, such as tantalum and columbium, have generally not been used in castings for industrial furnace parts. Furthermore, the use of the less scarce but still expensive alloying elements in furnace part castings can only be justified if those elements are effective as small fractions of alloy compositions. In particular, it is very desirable to reduce the nickel content of alloys for furnace part castings whenever possible, nickel being relatively expensive and constituting a major proportion of such alloys.

An additional consideration in the development of alloys for furnace castings is the now well established fact that for high hot strength and reasonably long service life at furnace temperatures of about 1500° F. to about 2000°-2100° F. such alloys must retain wholly austenitic (face-centered cubic) matrix structures. Ferritic (body-centered cubic) matrix or unstable matrix structures must be avoided.

Roy et al., U.S. Pat. No. 3,165,400, discloses alloys said to have an austenitic structure at room temperature useful for turbine rotor blade castings as well as other applications where temperatures up to about 1500° are encountered. Roy et al. broadly disclose a variety of alloy compositions described (col. 5, line 36 to col. 6, line 35) as having about 0.8 to 1.25% carbon, about 2 to 8% nickel, about 1 to 15% manganese, about 12 to 35% chromium, and a plurality of elements selected from molybdenum, tungsten and metals from the group columbium and tantalum in amounts not greater than about 12%. Various provisos are disclosed with respect to the maximum amounts of certain combinations of these elements. Additional desirable elements are said to include 0 to about 2.5% silicon, 0 to about 0.6% nitrogen, and 0 to about 8% cobalt. Also disclosed is the replacement of a portion of the iron in the alloys with up to 5% titanium, up to 5% vanadium, up to 1% boron, and up to 0.2% phosphorus, plus incidental elements such as zirconium, aluminum and magnesium. Nevertheless, the alloys of Roy et al. must contain at least 40% iron.

Even though the alloys of Roy et al. are said to have an austenitic structure at room temperature, the alloys of Roy et al. would not be expected to remain austenitic in service at high temperatures, for even such short periods as several hours up to about two months, based upon the test results and properties set forth in the patent. For example, while the photomicrographs of the Roy et al. alloys (FIGS. 1-7) show the presence of austenite, carbides are also present after only 100 hours (4 days) of exposure at 1500° F. Accordingly, based upon their compositions, the exemplary alloys of Roy et al. are almost all prone to the detrimental formation of sigma phase at service temperatures, drastically limiting service life. Thus, while such alloys may remain free of sigma phase for a limited time, critical amounts would be expected to form after two or three months of service have passed.

At about the time the Roy et al. patent issued (1965) many metallurgists hoped and believed that substantial amounts of manganese, possibly along with quantities of nitrogen, could be substituted for all or most of the nickel in heat-resistant alloys to provide alloys having improved heat resistance. These hopes met with failure. Low-nickel, high-manganese, heat-resistant alloys that gave good results in the 100 or 1000 hour creep and rupture tests were prone to embrittlement and failure in service. Thus, while Roy et al. disclose very broad component ranges, they do not teach how to formulate alloys of sufficiently high chromium and low nickel contents to withstand hot gas corrosion above about 1650° F. Further, the reference does not teach how to formulate low-nickel alloys that retain a truly stable austenitic structure at high temperatures for the service life periods typically required of furnace parts.

SUMMARY OF THE INVENTION

Among the several objects of the present invention, therefore, may be noted the provision of improved alloys of very high hot strength and improved creep and rupture life in the temperature range of about 1500° F. to 2100° F.; the provision of such alloys having structurally stable austenitic matrices at those temperatures; the provision of such alloys having excellent resistance to hot gas corrosion; the provision of such alloys that may be readily air-meltable and castable into structural parts for industrial furnaces and similar applications; the provision of such alloys containing relatively low amounts of nickel and other critical elements; the provision of such alloys that are weldable and machinable; the provision of such alloys having reduced raw material costs as compared to existing alloys having comparable properties; and the provision of such alloys that may be economically formulated from ferroalloys and scraps.

Briefly, therefore, the present invention is directed to air-meltable, castable, machinable, weldable heat-resistant alloys that are very resistant to hot gas corrosion and that exhibit high creep rupture strengths. The instant alloys consist of, by weight, about 7.5 to about 18% nickel, about 23.5 to about 35% chromium, about 0.85 to about 1.4% carbon, about 0.2 to about 1.8% molybdenum, about 0.2 to about 1.6% tungsten, about 0.1 to about 1.6% columbium (niobium), about 0.2 to about 4% manganese, about 0.2 to about 2.5% silicon, up to about 1.5% cobalt, up to about 0.6% titanium, up to about 0.4% zirconium, up to about 0.4% rare earth elements, up to about 0.1% boron, up to about 0.7% nitrogen, and the balance essentially iron plus the usual minor impurities.

Figure 1:
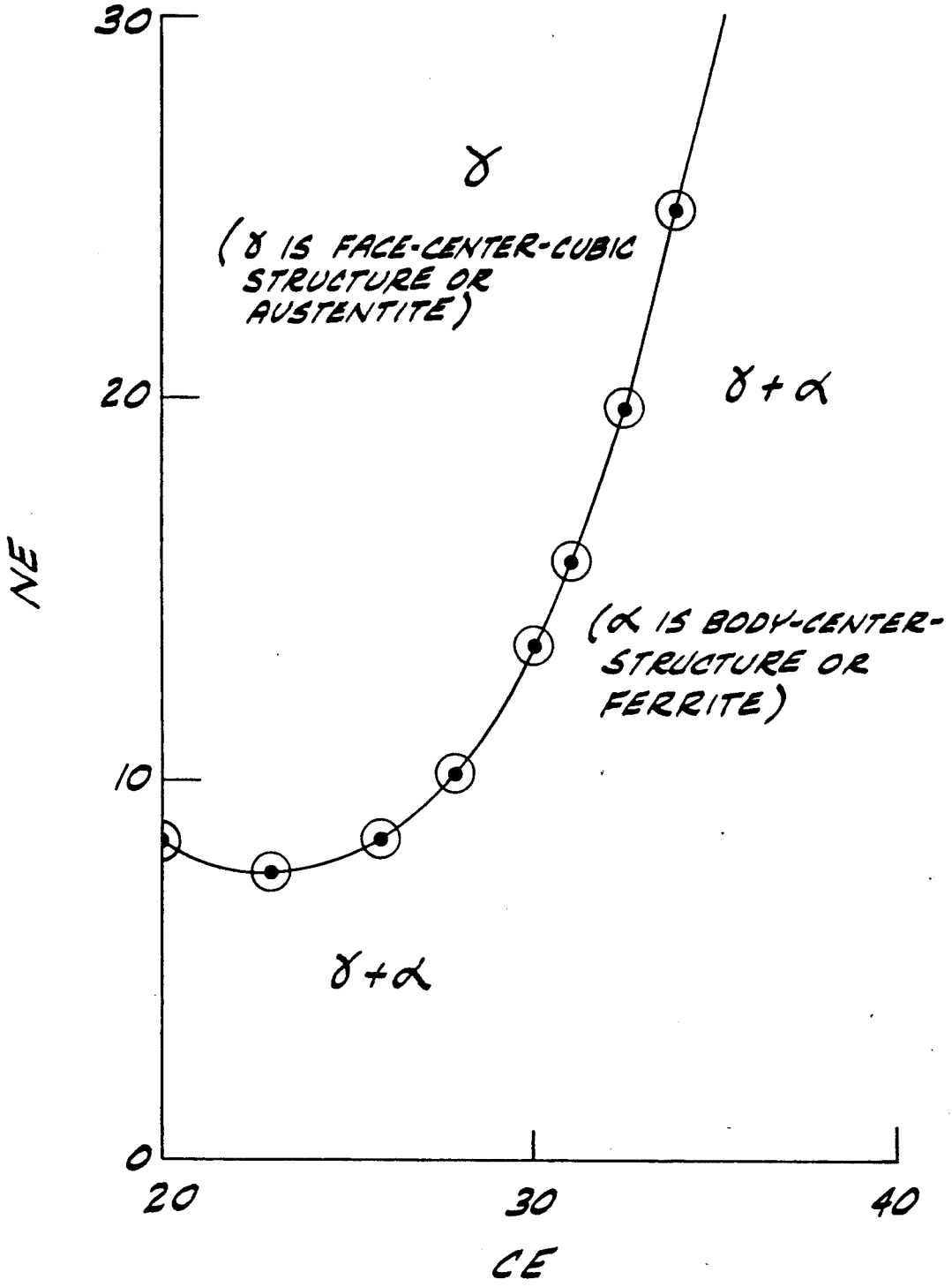
FIG. 1 is a graphic illustration, for high carbon alloys, of the expression (discussed below)

$$NE = \frac{(CE - 23)}{16.79} 2.37 + 7.5$$

which allows the determination of the minimum nickel content needed in such alloys in order for those alloys to retain their austenitic structure under service conditions of the order of 1500° to 2100° F. (815° to 1200° C.).

DESCRIPTION OF THE PREFERRED EMBODIMENT

In accordance with the present invention, alloys are provided which have high hot strength and excellent hot gas corrosion resistance essentially equal to the best standard and/or improved SFS-ACI alloys but at relatively low nickel content. Thus, the alloys of the invention have the following composition:

| | |
|---|---|
| Nickel | 7.5 to 18% by weight |
| Chromium | 23.5 to 35% |
| Carbon | 0.85 to 1.4% |
| Molybdenum | 0.2 to 1.8% |
| Tungsten | 0.2 to 1.6% |
| Columbium (niobium) | 0.1 to 1.6% |
| Manganese | 0.2 to 4% |
| Silicon | 0.2 to 2.5% |
| Cobalt | up to about 1.5% |
| Titanium | up to about 0.6% |
| Zirconium | up to about 0.4% |
| Boron | up to about 0.1% |
| Nitrogen | up to about 0.7% |
| Rare earth elements | up to about 0.4% |
| Iron | essentially the balance |

Hot strengths of alloys of the present invention are approximately equal to the best improved SFSA-ACI HP grade alloys which have 33% to 39% nickel even though the alloys of the invention advantageously only have nickel contents between about 7.5% to about 18%. This reduction in nickel content represents a significant reduction in critical element content and raw material cost.

Nickel contents of the alloys of the present invention must be at least about 7.5% to provide stable matrix structures. On the other hand, greater than about 18% nickel results in reduced rupture life and increases raw material costs.

It has been found that a minimum of about 23.5% chromium is necessary in alloys of the invention to ensure adequate hot gas corrosion resistance. With carbon levels at the high end of the allowed range, chromium may be as high as 35%, but about 25% to 29% chromium is preferable. If carbon, nitrogen, nickel and manganese are all held to the higher ends of their ranges in the alloys of the invention, while molybdenum, tungsten, columbium (niobium), titanium and zirconium are all held to the low ends of their ranges, chromium contents can be as high as 35% without the risk of matrix-structure transformation to ferrite or sigma phases, but generally about 30% chromium or less (i.e. about 25 to 29%) is preferred if maximum hot strengths are to be achieved.

Alloys of the present invention contain a maximum of about 4% manganese. At higher manganese contents castings from the instant high carbon alloys are susceptible to severe deterioration of their surface when melted in ordinary furnace linings and cast in ordinary mold materials. A major cause of this problem is that the formation of manganese oxides becomes excessive above about 4% manganese in the instant alloys. Since manganese oxides are basic materials they chemically react with the acidic furnace and mold materials and produce gas holes and slags in the surface of the castings.

Silicon is commonly employed in ordinary steel-making practice as a deoxidizer, but greater than about 2.5% silicon in alloys of the invention causes an undesired reduction in hot strength and rupture life. Therefore, silicon content should be maintained between about 0.2% and about 2.5%, preferably between about 0.2% and about 2%.

The ranges of molybdenum, tungsten, columbium (niobium), titanium, boron, zirconium and cerium (rare earth metals) set forth above are all sufficiently high to provide optimum hot strengths but not high enough to destabilize the matrix structures and form deleterious additional phases.

Cobalt, known to be present in scraps as well as certain deposits of nickel ores, has been found to have no deleterious effect upon alloys of the invention at least up to about 1.5% cobalt.

While alloys of the invention possess high solubility limits for nitrogen, up to as much as 0.7%, only up to about 0.3% nitrogen was found to be effective in permitting reduction in nickel content. It was also found that the desired properties of alloys of the invention could not be retained if the nickel content of the alloys was reduced below about 7.5% regardless of whether or not nitrogen was present in significant quantities.

For maximum long term stability of the austenitic matrices in the high carbon alloys of the invention, i.e., alloys of about 1% carbon, over service life periods beyond about a few months, it has been discovered that the following expression provides a basis for determining the lowest acceptable nickel content based upon the amounts of certain other alloying elements present:

$$NE = \frac{(CE - 23)}{16.79} 2.37 + 7.5$$

in which

NE (nickel equivalent)=% Ni+0.6(% Mn)+20(% N)+% Co; and

CE (chromium equivalent)=% Cr+0.8(% Mo+% W)+1.75(% Cb+% Zr)++3.2(% Ti)+1.1(% total rare earth elements);

provided that, NE is in the range of about 7.6 to about 28 and the % N is up to 0.3% and CE is in the range of about 24 to 35. For alloys having a nitrogen content above about 0.3% the percent nitrogen used in the calculation remains at 0.3%.

Refering to FIG. 1, the alloys having long term stability according to the foregoing expression are those falling above and to the left of the curve of FIG. 1. Those alloys are described in FIG. 1 as having essentially a gamma structure, i.e., as having a face-center cubic structure or austenite.

Alloys which employ less nickel and/or more manganese and/or more nitrogen to attain the NE values in the above relationship do not provide stable austenitic matrix structures after fairly long-term exposure to high service temperatures. For example, a higher manganese content eventually promotes the formation of sigma and/or ferrite phases in the instant alloys unless large nickel additions are included in their formulation to help offset this manganese effect Employment of more than about 0.3% nitrogen as a partial substitute for nickel in these high-carbon alloys may result in the formation of sigma and/or ferrite after long-term exposures because a portion of the nitrogen tends to precipitate from the matrix as stable nitrides or carbonitrides and is thus removed from matrix reactions.

It has also been discovered that the best hot strengths over long service lives for the high-carbon alloys of the invention are provided when NE values are about 3 to 4 units above those determined for the minimun NE value. Also, while higher nickel contents and higher NE values than those given by the above expression will result in stable austenitic alloys, the hot strengths of such alloys tend to decline if the NE value is greater than about 3 to 4 units above the value determined from the formula above or if the nickel content exceeds the amount of nickel determined from the expression by more than about 3 to 4%.

On the other hand, it has been found that increasing the chromium level in alloys of the invention that otherwise have the same composition and therefore increasing CE results in reducing the hot strength of those alloys. For example, in a high carbon alloy of the invention having 24% chromium, no nitrogen, 1.1% manganese and other carbide formers so that the CE value is 26.5, the best long term hot strength would be for alloys having between about 8% and 11% to 12% nickel (about 8.7 NE and 11.7 to 12.7 NE, respectively) If the amount of the other elements is kept constant but the chromium content is increased to about 28% (CE about 30.5) the best hot strengths are not for the same NE values or percent nickel but reside at higher nickel amounts, about 14% to about 16 to 17% nickel (higher NE values, respectively, of about 14.6 to about 17.6 to 18.6). Thus, in this example, by formulating with NE values about 3 to 4 units above the minimum determined from the above expression for the initial alloy (24% Cr), which is conveniently done by increasing the nickel content 3-4%, an increase in chromiumn content of 4% does not cause any significant loss in the heat strength of the alloy. Of course, at higher chromium levels it may be necessary to reduce the amount of molybdenum, tungsten, columbium and/or cobalt to maintain the maximum hot strength in order not to exceed the maximum allowable amount of nickel.

For further improvements in hot strength and rupture life, the alloys of the invention may also contain from about 0.1 to about 0.6% titanium. For excellent hot gas corrosion resistance, thermal fatigue resistance, high hot strengths and good creep rupture properties, essentially equal to the best improved SFSA-ACI alloys, over most of the temperature range of 1500°-2100° F. (about 800°-1150° C.), the alloys of the invention may further contain small additions of zirconium, boron and rare earth elements as set forth above.

When molybdenum, tungsten, columbium, titanium, zirconium, and possibly boron, cerium and nitrogen, are employed in alloys of the invention, the first three of those elements may be present in total amounts of about 1.4% to about 1.7% while still achieving high hot strengths at the high chromium levels typical of the alloys of the invention. At lower levels of ferrite-forming elements, on the order of about 1.8% to about 2.1% total of molybdenum, tungsten, columbium, titanium and zirconium, or those five elements plus cerium, the nickel content may be at the low end of the range specified above for alloys of the invention, on the order of about 7.5-11.5%. However, when only molybdenum, tungsten and columbium are employed as carbide formers, larger amounts, on the order of 3.1% to about 4% total, of these three elements and on the order of about 15% to about 18% nickel are preferred.

Therefore, while good hot strengths are achieved by the instant alloys with only the additions of molybdenum, tungsten and columbium, provided nickel contents are higher than the maximum levels set forth in the Roy et al. patent, the highest hot strengths for the those alloys are realized when titanium, zirconium and cerium are also present, and molybdenum, tungsten and columbium are provided in substantially lower amounts than those preferred in the exemplary alloys of Roy et al. This relationship is stated mathematically in the NE versus CE expression above, which applies to NE values and/or a nickel contents up to about 60%.

For excellent hot gas corrosion resistance, thermal fatigue resistance and the highest hot strength and creep rupture properties, essentially equal to the best improved SFSA-ACI alloys, over most of the temperature range where such alloys are typically used, the alloys of the invention may further contain small additions of zirconium, boron and the rare earth elements, so that these components are provided in the following ranges of proportions:

| | |
|---|---|
| Nickel | 7.5 to 18% by weight |
| Chromium | 23.5 to 28% |
| Carbon | 0.85 to 1.15% |
| Molybdenum | 0.2 to 1.3% |
| Tungsten | 0.4 to 1.6% |
| Columbium | 0.1 to 1.6% |
| Titanium | 0.1 to 0.6% |
| Zirconium | 0.05 to 0.4% |
| Rare earth elements* | 0.04 to 0.15% |
| Boron | 0.003 to 0.08% |

-continued

| | |
|---|---|
| Manganese | 0.5 to 4% |
| Silicon | 0.2 to 1.5% |
| Iron | essentially the balance |

*Rare earth elements were added to these alloys in the form of mischmetal, which contained 50.1% cerium, 24.2% lanthanum, and 97.9% total of rare earth elements. The cerium content analyzed for in these tests therefore represents approximately one half of the total rare earth element contents recovered.

One preferred alloy within this range having particularly long service life and high hot strength at about 1750° to 2000° F., combined with good machinability and weldability, has the following nominal amounts of constituent elements:

| | |
|---|---|
| Nickel | 8.5% by weight |
| Chromium | 25% |
| Carbon | 1.1% |
| Molybdenum | 0.4% |
| Tungsten | 0.6% |
| Columbium | 0.4% |
| Titanium | 0.4% |
| Zirconium | 0.08% |
| Cerium | 0.02% |
| Boron | 0.005% |
| Manganese | 3.6% |
| Silicon | 0.6% |
| Cobalt | 0.15% |
| Nitrogen | 0.08% |
| Iron | essentially the balance |

For excellent hot gas corrosion resistance, and creep rupture properties superior to all of the standard ACI grades, and essentially equal to or exceeding all improved ACI grades to about 1700° F. and all but the improved HP grades to about 2000° F., the preferred alloys of the invention contain the following ranges of specified components:

| | |
|---|---|
| Nickel | 13 to 18% by weight |
| Chromium | 25 to 28% |
| Carbon | 0.95 to 1.2% |
| Molybdenum | 0.9 to 1.8% |
| Tungsten | 0.9 to 1.6% |
| Columbium | 0.2 to 1.6% |
| Titanium | 0.1 to 0.6% |
| Zirconium | up to 0.3% |
| Cerium | up to 0.2% |
| Boron | up to 0.08% |
| Manganese | 0.2 to 1.5% |
| Silicon | 0.2 to 2% |
| Cobalt | up to 1.5% |
| Nitrogen | up to 0.25% |
| Iron | essentially the balance |

A preferred alloy of this type has nominally the following amounts of the specified components:

| | |
|---|---|
| Nickel | 17.5% by weight |
| Chromium | 25% |
| Carbon | 1.05% |
| Molybdenum | 1.1% |
| Tungsten | 1.5% |
| Columbium | 1% |
| Titanium | 0.15% |
| Zirconium | 0.1% |
| Cerium | 0.04% |
| Boron | 0.01% |
| Manganese | 0.6% |
| Silicon | 0.6% |
| Cobalt | 0.5% |
| Nitrogen | 0.08% |
| Iron | essentially the balance |

For excellent hot gas corrosion to 2000° F. and very good hot strength from 1500° F., essentially superior to all standard ACI alloys as well as many improved grades, the following ranges of specified components are preferred:

| | |
|---|---|
| Nickel | 8.5 to 18% by weight |
| Chromium | 25 to 28% |
| Carbon | 1.0 to 1.3% |
| Molybdenum | 1.0 to 1.5% |
| Tungsten | 1.0 to 1.5% |
| Columbium | 0.9 to 1.2% |
| Titanium | 0.1 to 0.5% |
| Manganese | 0.2 to 1.5% |
| Silicon | 0.2 to 2% |
| Cobalt | up to 1.5% |
| Nitrogen | up to 0.25% |
| Iron | essentially the balance |

A preferred formulation within this range has nominally the following amounts of the specified components:

| | |
|---|---|
| Nickel | 17.5% by weight |
| Chromium | 27% |
| Carbon | 1.05% |
| Molybdenum | 1.1% |
| Tungsten | 1.4% |
| Columbium | 1.1% |
| Titanium | 0.15% |
| Manganese | 0.6% |
| Silicon | 0.6% |
| Cobalt | 0.5% |
| Iron | essentially the balance |

For excellent hot gas corrosion to 2100° F., very good hot strength from 1500° F. to 1700° F., and good hot strength to 2000° F., essentially superior to all standard ACI type alloys, the following ranges of specified components are preferred:

| | |
|---|---|
| Nickel | 15 to 18% by weight |
| Chromium | 24 to 35% |
| Carbon | 1.0 to 1.3% |
| Molybdenum | 1.0 to 1.3% |
| Tungsten | 1.2 to 1.5% |
| Columbium | 0.4 to 1.1% |
| Manganese | 0.2 to 3.8% |
| Silicon | 0.2 to 2% |
| Nitrogen | up to 0.40% |
| Cobalt | up to 1.5% |
| Iron | essentially the balance |

A preferred formulation within these ranges of elements has been found to have the following nominal amounts of the specified components:

| | |
|---|---|
| Nickel | 17.5% by weight |
| Chromium | 27% |
| Carbon | 1.1% |
| Molybdenum | 1.1% |
| Tungsten | 1.4% |
| Columbium | 1.1% |
| Manganese | 0.6% |
| Silicon | 0.6% |
| Iron | essentially the balance |

The following examples further illustrate the invention:

EXAMPLE I

Heats of several different alloys were prepared in accordance with the invention. Well-risered standard ASTM test bar keel blocks were cast from each heat. The composition of these alloys is set forth in Table I with the balance in each case being essentially iron.

Eight tensile test bars were prepared for each alloy of the invention shown in Table I. The room-temperature properties for the alloys of the invention are set forth in Table III. Samples from each of the heats were also tested for magnetic permeability. All inventive alloys measured less than 1.01 gausses per oersted, that is, they had no measurable magnetic permeability. Inasmuch as ferrite is a ferromagnetic phase at or near room temperature, this test indicated no measurable quantity of ferrite in the as-cast alloys of the invention.

Heats of several comparative alloys not of the invention were also prepared and cast into standard test bar keel blocks. The compositions of these alloys are set forth in Table II, with the balance in each instance being essentially iron.

Test bars for the comparative alloys MT-HP42, HK-885, HH-848, HT-890, HN-877, ACI-HP, ACI-HK, ACI-HH, ACI-HN and ACI-HT were cast from commercial full-size heats whereas three 100 pound heats were melted for each comparative alloy X15-31 and 12-25-lC. Only the analysis for the first heat for each of the latter alloy types is given in Table II for the sake of brevity. The second and third heats for each of these two types had substantially identical chemical analyses with each of their respective first heats.

TABLE I

ALLOYS OF THE INVENTION
COMPOSITION BY WEIGHT PERCENTAGES

| ALLOY NO. | Ni | Cr | C | Mo | W | Cb | Ti | Zr | Ce | B | N | Mn | Si | Co |
|---|---|---|---|---|---|---|---|---|---|---|---|---|---|---|
| H-913 | 8.46 | 25.03 | 1.12 | .43 | .63 | .37 | .42 | .08 | .06 | .053 | .06 | 3.62 | .66 | .35 |
| H-914 | 17.53 | 26.95 | 1.09 | 1.06 | 1.38 | 1.05 | .13 | .10 | .06 | — | — | .67 | .60 | .47 |
| H-921 | 8.78 | 25.11 | 1.07 | .36 | .61 | .36 | .37 | .07 | .05 | .008 | .13 | 3.49 | .72 | — |
| H-922 | 9.16 | 24.96 | 1.02 | 1.02 | .94 | .32 | .21 | .06 | .04 | — | — | 3.09 | .49 | — |
| H-923 | 9.53 | 25.21 | 1.06 | .53 | .89 | .38 | .12 | .12 | .06 | .013 | — | 3.34 | .52 | — |
| H-924 | 16.18 | 26.34 | 1.04 | 1.03 | 1.51 | 1.52 | .11 | .06 | .07 | .003 | — | .52 | .53 | — |
| H-925 | 15.51 | 27.20 | 1.05 | 1.27 | 1.51 | .26 | .21 | .11 | .07 | .012 | — | .58 | .55 | — |
| H-926 | 8.52 | 24.64 | 1.11 | .37 | .59 | .41 | .26 | .07 | .05 | .021 | .05 | 3.14 | .59 | .13 |
| H-928 | 7.82 | 24.25 | 1.06 | 1.11 | 1.02 | .96 | .13 | — | — | .002 | — | 3.89 | .51 | — |
| H-929 | 9.14 | 26.11 | 1.10 | .59 | .54 | .49 | .36 | .21 | .08 | .041 | .18 | .76 | .31 | — |
| H-930 | 15.76 | 26.85 | 1.08 | 1.01 | 1.14 | .96 | — | — | — | — | .12 | .58 | .62 | — |
| H-932 | 16.14 | 26.65 | 1.02 | 1.03 | 1.27 | 1.09 | — | — | — | — | — | .63 | .39 | — |
| H-933 | 10.27 | 26.14 | 1.05 | .96 | 1.05 | .88 | .16 | — | — | — | .08 | 1.53 | .57 | — |

TABLE II

ALLOYS NOT OF THE INVENTION
COMPOSITION BY WEIGHT PERCENTAGES

| ALLOY NO. | Ni | Cr | C | Mo | W | Cb | Ti | Zr | Ce | Mn | Si | Co |
|---|---|---|---|---|---|---|---|---|---|---|---|---|
| MT-HP42 | 35.88 | 23.96 | .42 | .36 | .52 | .48 | .11 | .13 | .09 | .22 | .76 | — |
| HP-904 | 37.11 | 23.48 | .45 | .55 | .39 | .42 | .09 | .18 | .04 | .74 | .64 | — |
| HP-911 | 37.28 | 23.26 | .45 | .13 | .23 | .21 | .15 | .09 | .06 | .92 | 1.05 | .14 |
| HT-890 | 36.05 | 17.21 | .61 | .20 | .72 | .31 | .10 | .18 | .04 | .59 | .60 | — |
| HN-877 | 25.06 | 21.45 | .46 | .19 | .29 | .37 | .19 | .21 | .05 | .47 | .81 | — |
| HK-885 | 20.22 | 24.54 | .43 | .52 | .22 | .08 | .16 | .09 | .14 | .72 | .83 | — |
| HH-848 | 14.09 | 24.85 | .41 | .24 | .51 | .21 | .12 | .29 | .09 | .39 | .59 | .08 |
| ACI-HP | 35.26 | 25.72 | .53 | — | — | — | — | — | — | .76 | .66 | .06 |
| ACI-HK | 21.14 | 25.66 | .46 | — | — | — | — | — | — | .66 | .81 | — |
| ACI-HH | 13.68 | 25.16 | .41 | — | — | — | — | — | — | .89 | .92 | — |
| ACI-HN | 25.13 | 21.21 | .43 | — | — | — | — | — | — | .66 | .62 | — |
| ACI-HT | 35.61 | 17.28 | .58 | — | — | — | — | — | — | .76 | .60 | .06 |
| X15-31 | 15.23 | 31.26 | 1.04 | — | — | — | — | — | — | .31 | .65 | — |
| H-912 | 13.53 | 24.62 | 1.03 | 2.50 | 1.28 | — | — | — | — | 3.87 | .63 | — |
| H-915 | 15.67 | 27.13 | .89 | 2.03 | 1.26 | — | — | — | — | .63 | .46 | — |
| 12-25-1C | 13.22 | 25.12 | 1.06 | — | — | — | — | — | — | .93 | .86 | — |

TABLE III

ROOM TEMPERATURE PROPERTIES

| ALLOY NUMBER | TENSILE STRENGTH P.S.I. | YIELD STRENGTH P.S.I. | TENSILE ELONGATION | BRINELL HARDNESS NUMBER |
|---|---|---|---|---|
| H-913 | 66,650 | 60,900 | 1.5% | 269 |
| H-914 | 61,650 | 56,750 | 1.0% | 255 |
| H-921 | 67,500 | 60,800 | 1.5% | 269 |
| H-922 | 62,400 | 53,660 | 1.5% | 265 |
| H-923 | 65,770 | 60,880 | 1.5% | 270 |
| H-924 | 68,000 | 52,750 | 2.5% | 255 |
| H-925 | 62,050 | 57,200 | 2.0% | 255 |
| H-926 | 67,100 | 61,100 | 1.5% | 265 |
| H-928 | 63,250 | 57,100 | 1.0% | 255 |
| H-929 | 68,250 | 59,600 | 1.8% | 260 |
| H-930 | 63,550 | 58,700 | 1.0% | 255 |
| H-932 | 70,650 | 56,140 | 2.0% | 255 |
| H-933 | 65,120 | 57,770 | 1.5% | 255 |

Samples of each of the inventive alloys were also measured for magnetic permeability after rupture life testing at each of the test temperatures. While some samples displayed magnetic permeabilities of as much as 1.05 to 1.10 gausses per oersted, corresponding to approximately 1% to 1.5% ferrite or equivalent, such readings are attributed to the badly oxidized surfaces. This is a common occurrence encountered in the surface scale of alloys exposed to elevated temperatures. Once the slight surface scale was removed, the underlying samples were tested and determined to have no detectable ferrite.

At least one sample of each heat of each alloy of the invention exposed to temperatures between 1500° F. and 2000° F. during the rupture life testing was cleaned, polished, etched and microscopically examined at 500X magnification for the presence of sigma phase. Neither ferrite nor sigma phase was observed in any of the samples of alloys of the invention either before or after long-term exposure at elevated temperatures. Large amounts of coalesced, precipitated carbides were readily apparent at 100X and 250X magnifications in all samples tested. Small amounts of nitride platelets were observed in some of the samples. Even though nitrogen was not intentionally added to the heats of the invention, some nitrogen was apparently either absorbed during the air melting or carried over in some of the melting stock.

EXAMPLE 2

Standard one-quarter inch diameter test bars were machined for each of the alloys of the invention and for each of the comparative alloys. The test bars were then tested at elevated temperatures in air on standard creep-rupture frames of the cantilever load type. Various stress values at 1500° F., 1600° F., 1800° F. and 2000° F. were selected so that heats of similar compositions would be subjected to as many comparative stress-rupture test loads at the various temperatures as could be practically selected with seven test bars each. The results of these tests at each temperature are set forth in Tables IV, V, VI, VII and VIII.

These test results indicate that the best alloys of the invention generally equalled or exceeded the comparative alloys in rupture lives at the various temperatures.

Comparative alloy MT-HP42, an HP-base alloy enhanced by the process set forth in U.S. Pat. No. 5,077,006, had a rupture life of 10,923.6 hours at 1700° F. and 5,000 psi. The alloys of the invention were not tested under these conditions because it was determined that such tests would take well over a year. Aside from this particular test, the alloys of the invention demonstrate remarkably high rupture lives at the various temperatures when compared to all other alloys including the premium very high nickel types.

TABLE IV

HOURS TO FAILURE AT 1500° F. UNDER VARIOUS STRESSES

| ALLOY NUMBER | STRESS, PSI 14,000 | 12,000 | 10,000 |
|---|---|---|---|
| H-913 | 488.9 | 2001.8 | — |
| H-914 | — | — | 3111.1 |
| H-921 | — | 2252.0 | 8219.2 |
| H-922 | 566.1 | — | 5661.7 |
| H-923 | 493.6 | 2007.2 | — |
| H-924 | 477.1 | 1492.9 | — |
| H-925 | — | 1417.1 | 5802.6 |
| H-926 | — | — | 8865.8 |
| H-928 | — | 2387.4 | — |
| H-929 | 501.1 | 1755.7 | — |
| H-932 | — | 982.8 | 2164.2 |
| H-933 | — | 1447.2 | — |
| MT-HP42 | 343.7 | 989.2 | 3601.9 |
| HK-885 | 241.5 | 1112.6 | 3819.8 |
| HH-848 | 15.2 | 43.9 | 737.5 |
| HN-877 | — | — | 790.6 |
| HT-890 | 30.7 | 101.2 | 376.4 |
| ACI-HP | — | — | 782.1 |
| ACI-HK | 51.6 | 106.1 | 386.4 |
| ACI-HH | 15.6 | 41.7 | 98.6 |
| X15-31 | 241.5 | 737.5 | 2387.6 |

TABLE IV-continued

HOURS TO FAILURE AT 1500° F. UNDER VARIOUS STRESSES

| ALLOY NUMBER | STRESS, PSI 14,000 | 12,000 | 10,000 |
|---|---|---|---|
| 12-25-1C | 151.0 | 386.5 | 1111.6 |
| H-915 | — | 2532.0 | — |
| H-912 | 305.6 | — | 3396.4 |

TABLE V

HOURS TO FAILURE AT 1600° F. UNDER VARIOUS STRESSES

| ALLOY NUMBER | STRESS, PSI 13,000 | 12,000 | 10,000 | 9,000 |
|---|---|---|---|---|
| H-913 | — | — | 392.7 | — |
| H-922 | — | 138.7 | — | 614.1 |
| H-923 | — | — | 381.6 | — |
| H-924 | 83.5 | 138.7 | — | — |
| H-925 | — | 179.6 | — | — |
| H-926 | — | 143.6 | — | — |
| H-928 | — | 128.4 | 314.0 | — |
| H-929 | — | — | 404.2 | 767.8 |
| H-930 | — | — | 388.5 | 576.5 |
| H-932 | 52.8 | — | 276.3 | — |
| H-933 | — | 114.8 | — | — |
| MT-HP36 | — | 65.7 | 251.1 | 549.2 |
| HK-885 | 37.5 | 56.6 | 280.8 | 538.4 |
| HH-848 | 2.4 | 4.3 | 13.1 | 18.3 |
| HN-877 | — | — | 27.9 | 85.5 |
| HT-890 | — | — | 31.6 | 83.2 |
| ACI-HP | — | — | 100.6 | 210.2 |
| ACI-HK | — | — | 61.3 | 111.5 |
| ACI-HH | 4.3 | 6.2 | 10.7 | 20.2 |
| ACI-HT | 7.3 | 11.4 | 43.7 | 76.5 |
| X15-31 | 33.6 | 55.6 | 169.8 | 314.0 |
| 12-25-1C | 17.1 | 30.0 | 82.1 | 143.6 |
| H-915 | 92.1 | 246.8 | 415.3 | — |
| H-912 | 43.0 | — | 224.6 | — |

TABLE VI

HOURS TO FAILURE AT 1700° F. UNDER VARIOUS STRESSES

| ALLOY NUMBER | STRESS, PSI 8,000 | 7,000 | 6,000 | 5,000 |
|---|---|---|---|---|
| H-913 | — | 420.8 | — | — |
| H-914 | — | 938.1 | 2193.4 | — |
| H-921 | — | 387.6 | — | — |
| H-922 | — | — | 840.3 | 3359.7 |
| H-924 | — | 358.1 | — | — |
| H-925 | 169.8 | — | — | — |
| H-926 | — | — | 1869.2 | — |
| H-928 | — | 339.5 | — | — |
| H-929 | — | — | 1778.6 | — |
| H-930 | — | 321.9 | 755.3 | 2463.5 |
| H-932 | — | 305.2 | — | — |
| MT-HP42 | 110.9 | 377.8 | 1772.2 | 10,923.6 |
| HK-826 | 161.0 | 398.4 | 934.8 | 3337.6 |
| HH-848 | — | 7.8 | 37.5 | 134.8 |
| HN-877 | 33.0 | 95.8 | 426.2 | 1531.7 |
| HT-890 | 20.2 | 46.3 | 131.9 | 586.8 |
| ACI-HP | 30.9 | 105.1 | 130.1 | 1287.2 |
| ACI-HK | 13.1 | 42.5 | 110.9 | 493.1 |
| ACI-HH | — | 8.4 | 22.0 | 46.4 |
| ACI-HT | 19.3 | 40.8 | 86.1 | 250.1 |
| X15-31 | 52.6 | 116.9 | 302.0 | 743.8 |
| 12-25-1C | 47.3 | 110.9 | 260.1 | 755.3 |
| H-915 | — | 269.1 | — | 1593.0 |
| H-912 | — | 185.4 | — | — |

TABLE VII

HOURS TO FAILURE AT 1800° F. UNDER VARIOUS STRESSES

| ALLOY NUMBER | STRESS, PSI 6,000 | 5,000 | 4,000 |
|---|---|---|---|
| H-913 | — | 778.6 | — |
| H-914 | — | 489.3 | 2786.9 |
| H-921 | — | 743.3 | 2858.8 |
| H-922 | — | 388.4 | — |
| H-923 | 189.7 | 561.7 | — |
| H-924 | — | 462.2 | 2576.7 |
| H-925 | 145.8 | 389.3 | — |
| H-926 | — | 817.2 | 2982.1 |
| H-928 | 148.1 | 461.3 | 2261.3 |
| H-929 | 177.9 | — | — |
| H-930 | 90.5 | 268.2 | — |
| H-932 | — | 296.7 | 1862.4 |
| H-933 | 167.7 | 426.2 | — |
| MT-HP42 | 145.7 | 638.5 | 2526.8 |
| HP-904 | 298.8 | 789.9 | 2786.2 |
| HP-911 | 182.6 | 816.7 | 2658.8 |
| HN-877 | 70.7 | 216.9 | 2040.4 |
| HT-890 | 27.3 | 57.7 | 442.6 |
| HK-885 | 87.5 | 447.0 | 887.3 |
| HH-848 | 8.5 | 23.5 | 79.9 |
| ACI-HP | 89.7 | 161.3 | 652.6 |
| ACI-HK | 38.8 | 79.6 | 221.3 |
| ACI-HH | 15.4 | 24.9 | 51.2 |
| ACI-HN | 94.6 | 193.8 | 576.9 |
| ACI-HT | 12.5 | 34.7 | 106.3 |
| X15-31 | 28.6 | 69.3 | 219.1 |
| 12-25-IC | 25.8 | 71.4 | 242.6 |
| H-915 | — | 171.8 | — |
| H-912 | — | 140.0 | — |

TABLE VIII

HOURS TO FAILURE AT 2000° F. UNDER VARIOUS STRESSES

| ALLOY NUMBER | STRESS, PSI 4,000 | 3,500 | 3,000 | 2,500 | 2,000 |
|---|---|---|---|---|---|
| H-913 | — | — | 284.2 | — | 1927.8 |
| H-914 | — | — | 155.6 | — | — |
| H-921 | — | — | 267.9 | 873.7 | — |
| H-923 | — | 77.6 | 281.1 | — | — |
| H-925 | — | — | — | — | — |
| H-926 | — | — | 279.1 | 759.9 | — |
| H-933 | 22.7 | 57.6 | 162.0 | — | — |
| MT-HP42 | 36.2 | 84.2 | 258.8 | 724.6 | 1589.3 |
| HP-904 | — | 122.3 | — | — | 873.7 |
| HP-911 | — | — | 342.7 | 871.5 | 1112.6 |
| HN-877 | 34.4 | 81.7 | 353.6 | 430.6 | 844.9 |
| HT-890 | 7.7 | 26.0 | 124.4 | 203.6 | 1098.1 |
| HK-885 | — | 18.8 | 163.5 | 312.3 | 959.5 |
| HH-848 | 2.8 | 7.1 | 23.0 | 34.8 | — |
| ACI-HP | — | — | 80.2 | 143.6 | 284.2 |
| ACI-HK | — | 4.6 | 29.9 | 62.1 | 161.5 |
| ACI-HH | 2.1 | 5.3 | 17.2 | 18.2 | 101.4 |
| ACI-HN | 37.7 | — | 142.1 | 392.1 | — |
| ACI-HT | 3.2 | 7.6 | 12.3 | 31.3 | — |
| X15-31 | — | 5.3 | 9.8 | 20.3 | — |
| 12-25-IC | 3.5 | 6.4 | 14.2 | 26.2 | — |
| H-915 | — | — | 93.2 | — | — |
| H-912 | — | — | 60.7 | 177.9 | — |

The present invention therefore provides alloys having outstanding hot strengths and resistance to hot gas corrosion while employing high contents of carbon and chromium at low contents of nickel and other critical alloys.

In view of the above, it will be seen that the several objects of the invention are achieved.

Although specific examples of the present invention and its application are set forth herein, it is not intended that they are exhaustive or limiting of the invention. These illustrations and explanations are intended to acquaint others skilled in the art with the invention, its principles, and its practical application, so that they may adapt and apply the invention in its numerous forms, as may be best suited to the requirements of a particular use.

What is claimed is:

1. A nickel-chromium-iron alloy consisting essentially of about:

| | |
|---|---|
| Nickel | 7.5–18% by weight |
| Chromium | 23.5–35 |
| Carbon | 0.85–1.4 |
| Molybdenum | 0.2–1.8 |
| Tungsten | 0.2–1.6 |
| Columbium | 0.1–1.6 |
| Manganese | 0.2–4 |
| Silicon | 0.2–2.5 |
| Cobalt | up to about 1.5 |
| Titanium | up to about 0.6 |
| Zirconium | up to about 0.4 |
| Boron | up to about 0.1 |
| Nitrogen | up to about 0.7 |
| Rare earth elements | up to about 0.4 |
| Iron | essentially the balance |

2. An alloy of claim 1 where the carbon content is at least about 1%, each of molybdenum, tungsten and columbium is from about 1.0% to about 1.6% and nitrogen is up to about 0.3%.

3. An alloy of claim 1 containing about 0.1 to about 0.6% titanium.

4. An alloy of claim 3 containing about 0.05% to about 0.4% Zr, about 0.002% to about 0.1% B and about 0.04% to about 0.4% rare earth elements.

5. An alloy of claim 1 consisting essentially of about:

| | |
|---|---|
| Nickel | 7.5–18 by weight |
| Chromium | 23.5–28 |
| Carbon | 0.85–1.15 |
| Molybdenum | 0.4–1.6 |
| Tungsten | 0.2–1.6 |
| Columbium | 0.1–1.6 |
| Titanium | 0.1–0.6 |
| Zirconium | 0.05–0.4 |
| Rare earth elements | 0.04–0.15 |
| Boron | 0.003–0.08 |
| Manganese | 0.5–4 |
| Silicon | 0.2–1.5 |
| Iron | essentially the balance |

6. An alloy of claim 4 consisting essentially of about:

| | |
|---|---|
| Nickel | 8.5% by weight |
| Chromium | 25 |
| Carbon | 1.1 |
| Molybdenum | 0.4 |
| Tungsten | 0.6 |
| Columbium | 0.4 |
| Titanium | 0.4 |
| Zirconium | 0.08 |
| Rare earths | 0.04 |
| Boron | 0.005 |
| Manganese | 3.6 |
| Silicon | 0.6 |
| Cobalt | 0.15 |
| Nitrogen | 0.08 |
| Iron | essentially the balance |

7. An alloy of claim 1 consisting essentially of about:

| | |
|---|---|
| Nickel | 13–18% by weight |
| Chromium | 25–28 |
| Carbon | 0.95–1.2 |
| Molybdenum | 0.9–1.8 |
| Tungsten | 0.9–1.6 |
| Columbium | 0.2–1.6 |
| Titanium | 0.1–0.6 |
| Zirconium | up to 0.3 |
| Rare earths | up to 0.04 |
| Boron | up to 0.08 |
| Manganese | 0.2–1.5 |
| Silicon | 0.2–2 |
| Cobalt | up to 1.5 |
| Nitrogen | up to 0.25 |
| Iron | essentially the balance |

8. An alloy of claim 6 consisting essentially of about:

| | |
|---|---|
| Nickel | 17.5% by weight |
| Chromium | 25 |
| Carbon | 1.05 |
| Molybdenum | 1.1 |
| Tungsten | 1.5 |
| Columbium | 1.0 |
| Titanium | 0.15 |
| Zirconium | 0.1 |
| Rare earths | 0.08 |
| Boron | 0.01 |
| Manganese | 0.6 |
| Silicon | 0.6 |
| Cobalt | 0.5 |
| Nitrogen | 0.08 |
| Iron | essentially the balance |

9. An alloy of claim 1 consisting essentially of:

| | |
|---|---|
| Nickel | 8.5 to 18% by weight |
| Chromium | 25 to 28% |
| Carbon | 1.0 to 1.3% |
| Molybdenum | 1.0 to 1.5% |
| Tungsten | 1.0 to 1.5% |
| Columbium | 0.9 to 1.2% |
| Titanium | 0.1 to 0.5% |
| Manganese | 0.2 to 1.5% |
| Silicon | 0.2 to 2% |
| Cobalt | up to 1.5% |
| Nitrogen | up to 0.25% |
| Iron | essentially the balance |

10. An alloy of claim 1 consisting essentially of:

| | |
|---|---|
| Nickel | 17.5% by weight |
| Chromium | 27% |
| Carbon | 1.05% |
| Molybdenum | 1.1% |
| Tungsten | 1.4% |

-continued

| | |
|---|---|
| Columbium | 1.1% |
| Titanium | 0.15% |
| Manganese | 0.6% |
| Silicon | 0.6% |
| Cobalt | 0.5% |
| Iron | essentially the balance |

11. An alloy of claim 1 consisting of:

| | |
|---|---|
| Nickel | 15 to 18% by weight |
| Chromium | 24 to 35% |
| Carbon | 1.0 to 1.3% |
| Molybdenum | 1.0 to 1.3% |
| Tungsten | 1.2 to 1.5% |
| Columbium | 0.4 to 1.1% |
| Manganese | 0.2 to 3.8% |
| Silicon | 0.2 to 2% |
| Nitrogen | up to 0.40% |
| Cobalt | up to 1.5% |
| Iron | essentially the balance |

12. An alloy of claim 1 consisting essentially of:

| | |
|---|---|
| Nickel | 17.5% by weight |
| Chromium | 27% |
| Carbon | 1.1% |
| Molybdenum | 1.1% |
| Tungsten | 1.4% |
| Columbium | 1.1% |
| Manganese | 0.6% |
| Silicon | 0.6% |
| Iron | essentially the balance |

13. An austenitic nickel-chromium-iron alloy of claim 1 containing about 0.85% to about 1.4% carbon and having long term stability of the austenitic structure at temperatures in the range of about 1500° to 2100° F., wherein the alloy has a minimum nickel content determined according to the following expression:

$$NE = \frac{(CE - 23)}{16.79} 2.37 + 7.5$$

in which

NE (nickel equivalent)=Ni+0.6(%Mn)+20(%N)+%Co; and

CE (chromium equivalent)=%Cr+0.8(%Mo+%W)+1.75(%Cb+%Zr)+3.2(%Ti)+1.1X (% total rare earth elements);

provided that, NE is in the range of about 7.6 to about 28 and the % N is up to about 0.3% and CE is in the range of about 24 to about 35.

14. An alloy of claim 13 where the % Cr is in the range of about 25–29%.

15. An alloy of claim 13 containing about 1% C.

* * * * *